US008925956B1

(12) United States Patent
Harkin

(10) Patent No.: US 8,925,956 B1
(45) Date of Patent: Jan. 6, 2015

(54) SNOWSHOE-SKI THAT ALLOWS USER TO GLIDE DOWNHILL AS WELL AS CLIMB

(71) Applicant: James B. Harkin, Bend, OR (US)

(72) Inventor: James B. Harkin, Bend, OR (US)

( * ) Notice: Subject to any disclaimer, the term of this patent is extended or adjusted under 35 U.S.C. 154(b) by 0 days.

(21) Appl. No.: 13/728,358

(22) Filed: Dec. 27, 2012

Related U.S. Application Data

(60) Provisional application No. 61/581,413, filed on Dec. 29, 2011.

(51) Int. Cl.

| | |
|---|---|
| ***A63C 5/04*** | (2006.01) |
| ***A63C 7/00*** | (2006.01) |
| ***A63C 5/044*** | (2006.01) |
| ***A63C 13/00*** | (2006.01) |

(52) U.S. Cl.
CPC ..... *A63C 5/044* (2013.01); *A63C 13/003* (2013.01)
USPC ..... 280/604; 280/609

(58) Field of Classification Search
USPC ..... 36/122–125; 280/14.1–19.1, 604, 601
See application file for complete search history.

(56) References Cited

U.S. PATENT DOCUMENTS

| | | | | |
|---|---|---|---|---|
| 3,861,698 | A * | 1/1975 | Greig | 280/604 |
| 5,649,722 | A * | 7/1997 | Champlin | 280/818 |
| 7,080,850 | B2 | 7/2006 | Ekberg | |
| 7,681,904 | B2 | 3/2010 | Ekberg | |
| 2001/0038192 | A1 | 11/2001 | McManus et al. | |
| 2002/0008360 | A1 * | 1/2002 | Ellington | 280/14.21 |
| 2004/0021297 | A1 | 2/2004 | Ekberg et al. | |

* cited by examiner

*Primary Examiner* — Jeffrey J Restifo
*Assistant Examiner* — Erez Gurari
(74) *Attorney, Agent, or Firm* — Clifford Kraft

(57) ABSTRACT

A snowshoe/ski that allows a rider to glide and turn going downhill as well as to climb and navigate a variety of terrain in varying snow conditions. At its base is a center ski which operates on hard-pack snow surrounded by an integrated outer ski or hull that creates buoyancy in deep powder preventing the device from sinking. The center ski has a fine scaled traction area under the foot zone that allows it to slide forward but not backwards. The underside of the main body has an exaggerated version of this traction extending a little beyond the foot zone but away from tip and tail granting maximum glide. The top of the device has a convex shape keeping unwanted snow from building up and weighing down the wearer. The present invention thus relates to a hybrid device that combines elements from snowshoes and cross-country and/or downhill skis.

4 Claims, 3 Drawing Sheets

SNOWSHOE-SKI THAT ALLOWS USER TO GLIDE DOWNHILL AS WELL AS CLIMB

This application is related to, and claims priority from, U.S. Provisional Patent application No. 61/581,413 filed Dec. 29, 2011. Application 61/581,413 is hereby incorporated by reference in its entirety.

BACKGROUND

1. Field of the Invention

The present invention relates to devices for snow sports and more particularly to a snowshoe-ski that allows a user to glide downhill and to climb uphill.

2. Description of the Prior Art

The prior art teaches devices that allow a user to snow shoe uphill and other devices that allow user to glide downhill. While some solutions have addressed the problem of snow shoes not being able to glide forward, the prior art generally teaches shapes that do not adequately turn going downhill. Prior art traction devices are complicated with moving parts that may clog with snow, or require the wearer to go backwards half a step to engage the device.

SUMMARY OF THE INVENTION

The present invention provides a way for snow sports enthusiasts to go snowshoeing and also be able to glide or rest on the downhills. It can be used by participants of any ability on a wide variety of terrain from flat areas to climbing and descending steep mountain chutes. The device of the present invention turns well in powder and is shorter than skis, making it easier to plow through crud or crusty, slushy conditions. The snowshoe/ski of the present invention allows user to glide with each step like a cross-country ski in the diagonal stride, making it more efficient than a snowshoe. The user can also skate ski on it. The snowshoe/ski is a very versatile, and makes for a unique snow sports experience.

DESCRIPTION OF THE FIGURES

Attention is now directed to several drawings that illustrate features of the present invention:

FIG. 4 also shows two different static traction types

DETAILED DESCRIPTION

The present invention relates to a snowshoe/ski device that allows a snowshoe wearer to glide as well as climb.

Figure 1:
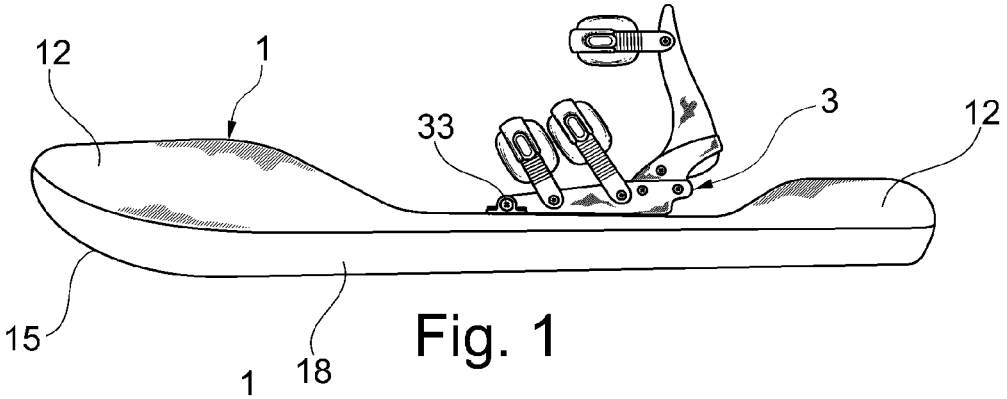
FIG. 1 is a side view of the snowshoe/ski with the preferred embodiment showing the basic shape that allows the device to slide through the snow and keep the snow off of it.

FIG. 1 shows the basic shape of the main body or hull 1, the front end of which is curved upward like a ski but more like that of a boat hull. The hull is also curved on top 12 with an optional ridge 22 to allow snow to shed down and off to the sides. A runner or center ski shape 15 is affixed to the main hull 1. This center ski can be hour glass shaped, and is typically integrated rather than being a separate part. Also shown is the concave curve 18 of the transition between the overall perimeter shape 1 and the outer edge of the center ski 15 (See also FIG. 6).

Figure 5:
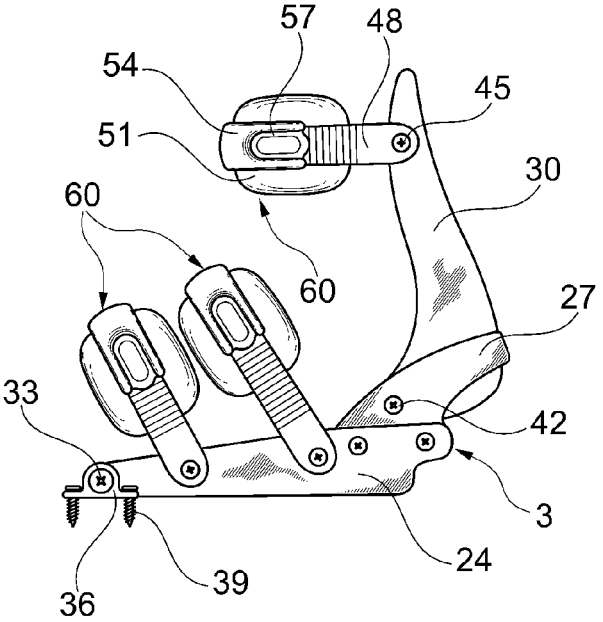
FIG. 5 is a side view of the binding showing its pivots, ratchet buckles and other elements.

Also shown is the binding 3 given in more detail in FIG. 5 and its forward pivot point 33. This pivot allows users heel to lift during ascents.

Figure 2:
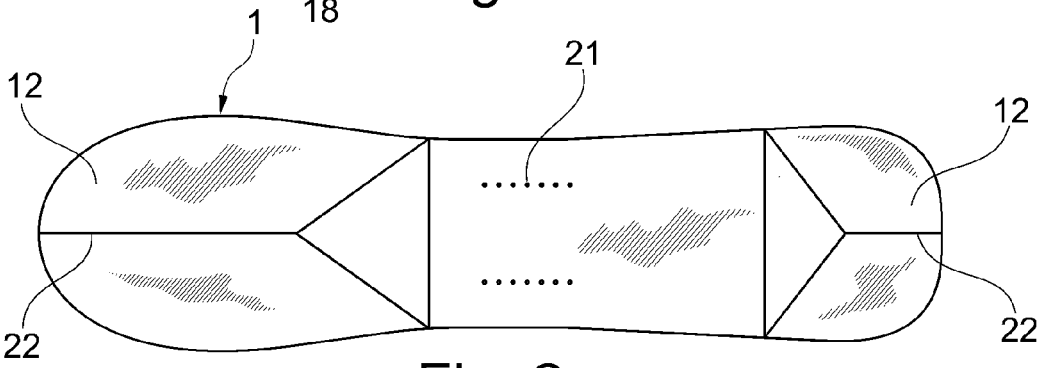
FIG. 2 is a top view of an embodiment without the binding attached that shows mounting holes for the binding. Also shown is the apex of curves that allows snow to shed off to the sides.

The hull 1 can be constructed of carbon fiber or a similar light-weight composite material or plastic. A two part mold is the easiest, most cost effective method of production. The two parts top and bottom can then be fused together. This typically allows the hull 1 to be hollow without a costly rotational casting and also allows for insertion of binding mounting sleeves or tee nuts. FIG. 2 Shows a top view of the hull 1 without the binding to show its adjustable mounting hole 21 locations. The bindings could be mounted forward of or back of ideal mounting position according to users personal preference. FIG. 2 shows the apex of the slope 12 that sheds snow to the left or right that could end up on top of snowshoe/ski. This allows foot to pull up, through, and above the snow while climbing or descending, keeping the unit from being weighed down by collected snow.

Figure 3:
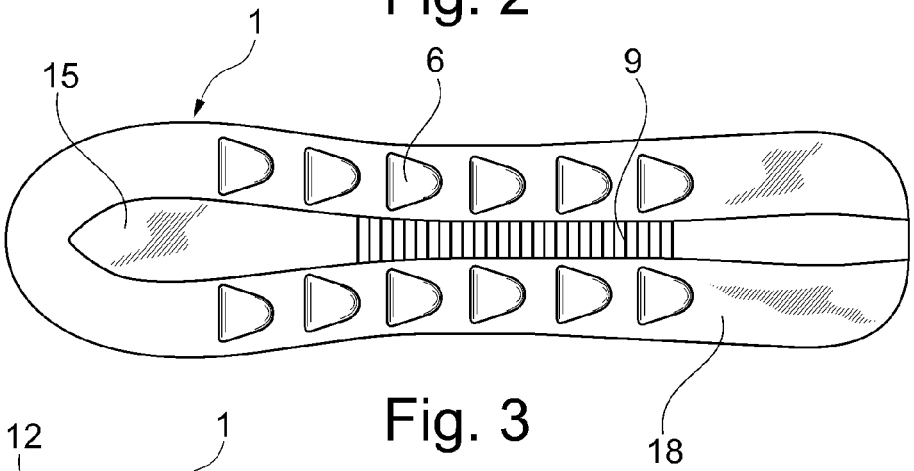
FIG. 3 is a bottom view of the embodiment of FIG. 2 showing the main body and its traction recesses, a smaller center ski with its micro step base traction, and the general shape of both body sections.

FIG. 3 depicts a view of the bottom of the Snowshoe/Ski. The basic perimeter shape of the hull 1 is shown. The hourglass or parabolic perimeter shape of the center ski 15 is shown, which allows the Snowshoe/Ski to turn like a downhill ski but with the ability to turn on a small radius because of its shorter length. The fine traction 9 shown with the transverse lines cut into the base utilizing currently available technology used in wax-less cross-country skis called fish scales or a step base. This traction on the center ski allows forward traction on hard packed snow, yet still lets the ski glide forward. The large traction 9 shown on the bottom curve 18, has much larger recesses molded into the bottom curve. These are almost perpendicular to the base on the leading edge, but gently taper back up to base level a few inches back. These are blown-up versions of the fish scales with no moving parts. These larger traction indentations aid in uphill traction in powder and deeper softer snow. Another option to the fine traction and the large traction is to use a mole hair cloth like horse hair in that one direction is smooth the other is rough. This should adhere in longitudinal slight in depth and width recesses in the same locations as 6 and 9.

Figure 4:
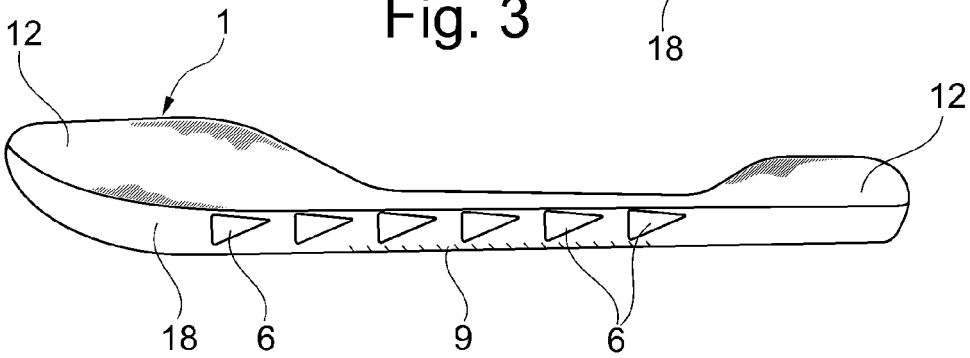
FIG. 4 is a side view showing the basic shape of the embodiment without the binding.

FIG. 4 is another side view showing the fine 9 and large 6 forward traction textures. The back of the snowshoe/ski can be square, both to the longitudinal center line and perpendicular to the ground which also helps it to not slide backwards.

FIG. 5 is a side view of the binding system 3 that secures riders foot to the foot bed atop the hull. This resembles the strap in bindings currently used on snow boards. Any suitable snow boot can be worn. The base of the binding 24 and the heel cup support 27 can be made out of aluminum or other rigid material. The heal cup 30 to be constructed of a rigid plastic or composite. The heal cup 30 will fold down for compact transportation on a pivot 42. The top strap of this torsionally rigid support keeps the lower leg transversely perpendicular to the hull. The bottom two straps hold the foot to the base of the binding 24. At the front of the base, on the vertical portion, a short threaded tube or stud can be fastened to the binding ninety degrees to the side rail. A mounting plate 36 slides over this stud acting as a pivot guide and is held in place using a spacer and an Allen bolt threaded into the other side of said stud. This mounting plate is fastened to the foot bed via the mounting sleeves depicted in FIG. 2 with Allen bolts 39 two on each side of foot.

The straps 60 can be made of plastic with synthetic pads 51 or any other suitable material. The textured strap portions 48 are held on to the binding on either side with a screw 45 which acts as a pivot as well keeping the binding usable for different foot sizes. The heal cup support 27 can be slotted at the mounting screw locations allowing it to also adjust forward and backward to accommodate different sizes of feet. One side of the strap is typically fed into a ratchet 57 and a ratchet lever 54 which is attached to the strap coming from the other side. This technology is known in the art of snowboarding equipment and works well for the ease of operation and secure method of attaching foot to the Snowshoe/ski of the present invention.

Figure 6:
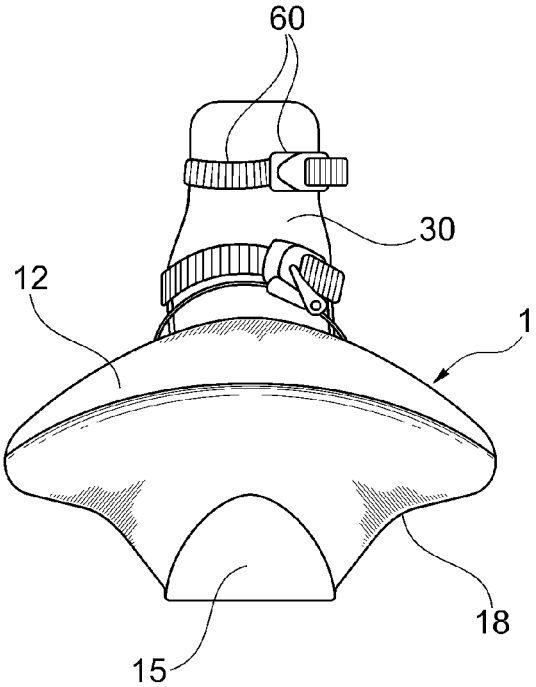
FIG. 6 is a front view showing the center ski and main body shape along with a portion of the binding.

FIG. 6 shows a front view of the Snowshoe/ski depicting the bottom curve 18 which allows the center ski 15 to be used and tipped on edge for turning and gliding on a hard pack without the upper section or main hull 1 touching the snow. In powder or soft deeper snow, the bottom curve and entire hull provide needed flotation similar to that which a snowshoe would normally provide. At faster speeds, less of the hull 1 rides in the snow. The top curve 12 that allows the snow to shed off the top of the hull is depicted here as well in FIG. 6. Also visible is the heal cup 30 and the straps 60.

Figure 7:
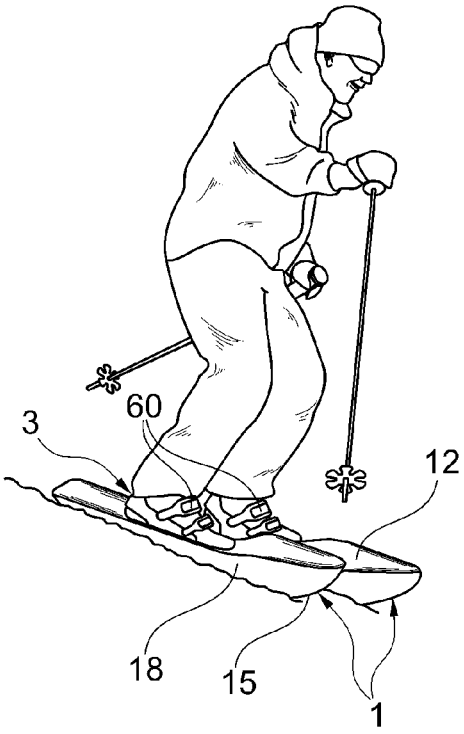
FIG. 7 is a perspective of the snowshoe/ski in use descending a moderate downhill slope.

FIG. 7 shows two snowshoe/skis in perspective being ridden, one for each foot. The user is descending a moderate incline in semi-soft snow. The hull 1 rides deeper in powder and completely on top of hard packed snow. Visible are the two hulls 1, the tip of the center ski 15, the bottom curve 18, the bindings 3, and the straps 60.

Figure 8:
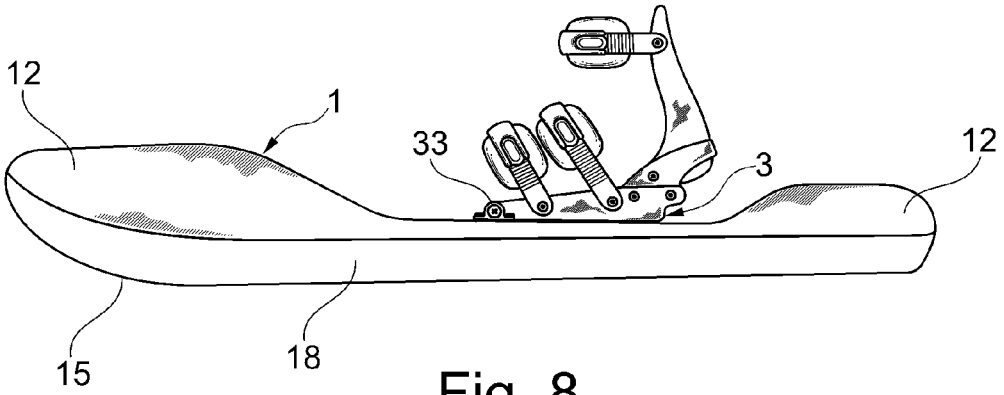
FIGS. 8-9 show a different embodiment with the front dome lowered.
Figure 9:
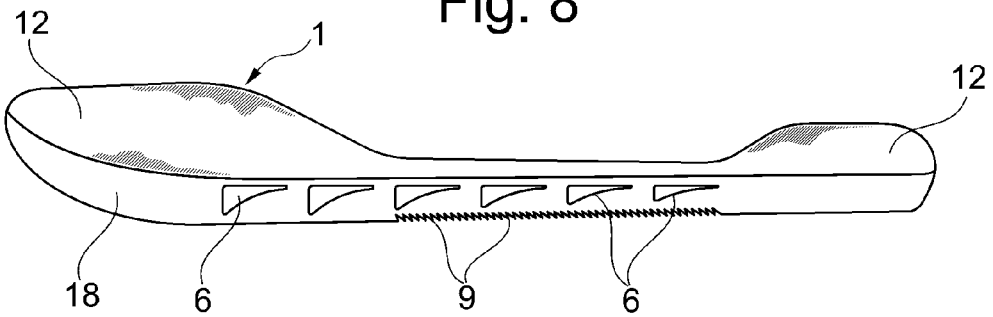

FIGS. 8-9 show a different embodiment of the present invention with the dome or curve 12 on the front lowered. It is still curved, but not as much as shown in FIGS. 1 and 4.

Figure 10:
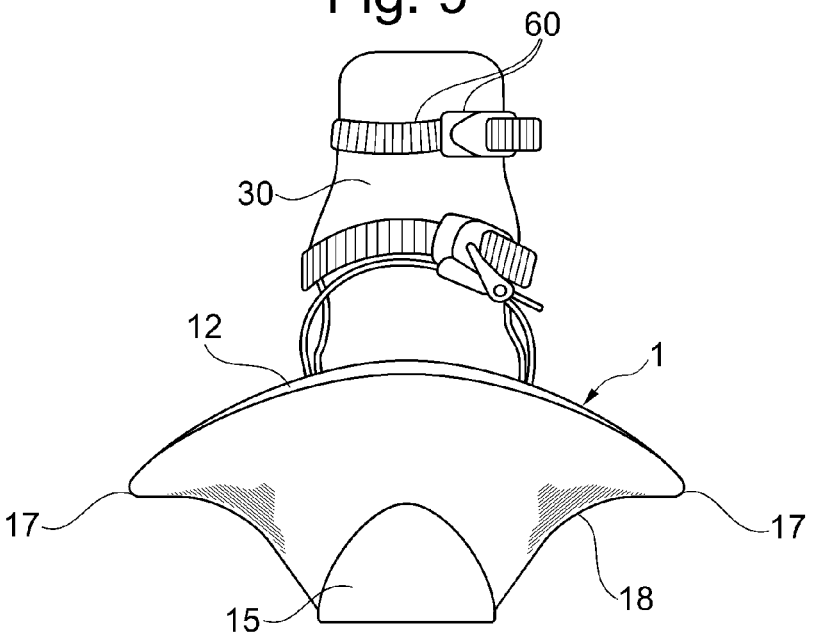
FIG. 10 shows a different embodiment with the edge of the hull being sharp.

FIG. 10 shows a different embodiment of the hull 1 that has a sharp, square edge 17. This edge 17 can optionally be metal for maximum performance.

Several descriptions and illustrations have been provided to aid in understanding the present invention. One with skill in the art will realize that numerous changes and variations are possible without departing from the spirit of the invention. Each of these changes and variations is within the scope of the present invention.

I claim:

1. A snoeshoe/ski comprising:

a single-piece hull ski having a top and bottom surface, and an upper and lower side surface, the top surface having a flat center section adapted to receive a user's foot, a solid thick, raised nose section forward of the center section, and a solid raised rear section aft of the center section, the rear section being raised less than the nose section;

the upper side surface forming a convex hull;

the lower side surface forming a concave hull;

the bottom surface being flat under the center and rear section, and curved upward under the noise section;

the lower side surface having a plurality of traction recesses along its length, the traction recesses oriented in an aft direction allowing forward gliding, but not backward gliding;

the ski having a set of bindings attached to the flat center section;

whereby a user wearing the ski can glide downhill and climb uphill.

2. The snowshoe/ski of claim 1 wherein the binding has a plurality of straps.

3. The snowshoe/ski of claim 2 wherein the binding has a first strap, a second strap and a third strap.

4. The snowshoe/ski of claim 3 wherein the third strap is an ankle strap.

* * * * *